US009335781B2

(12) United States Patent
Echegaray Martinez et al.

(10) Patent No.: US 9,335,781 B2
(45) Date of Patent: May 10, 2016

(54) REMOTE CONTROL FOR CONTROLLING MACHINERY

(71) Applicants: German Echegaray Martinez, Guipúzcoa (ES); Luis Alberto Botanz Holke, Guipúzcoa (ES); Sergio Alonso Rosco, Guipúzcoa (ES); Bertol Lekuona Gonzalez, Guipúzcoa (ES)

(72) Inventors: German Echegaray Martinez, Guipúzcoa (ES); Luis Alberto Botanz Holke, Guipúzcoa (ES); Sergio Alonso Rosco, Guipúzcoa (ES); Bertol Lekuona Gonzalez, Guipúzcoa (ES)

(73) Assignee: Angel Iglesias, S.A., San Sebastian (Guipuzcoa) (ES)

( * ) Notice: Subject to any disclaimer, the term of this patent is extended or adjusted under 35 U.S.C. 154(b) by 530 days.

(21) Appl. No.: 13/795,873

(22) Filed: Mar. 12, 2013

(65) Prior Publication Data

US 2014/0096637 A1 Apr. 10, 2014

(51) Int. Cl.
*G05G 1/02* (2006.01)
*G05G 1/08* (2006.01)

(52) U.S. Cl.
CPC .. *G05G 1/02* (2013.01); *G05G 1/08* (2013.01); *Y10T 74/20396* (2015.01)

(58) Field of Classification Search
CPC ..... Y10T 4/20396; G05G 1/02; G05G 1/08
See application file for complete search history.

(56) References Cited

U.S. PATENT DOCUMENTS

| | | | | |
|---|---|---|---|---|
| 2,642,145 | A * | 6/1953 | Feyes | 180/271 |
| 5,647,818 | A * | 7/1997 | Moody | 477/99 |
| 6,295,887 | B1 * | 10/2001 | DeJonge et al. | 74/473.3 |
| 6,621,406 | B2 * | 9/2003 | Kumano | 340/5.62 |
| 6,661,114 | B2 * | 12/2003 | Syamoto | 307/10.1 |
| 2002/0016233 | A1 * | 2/2002 | Syamoto | 477/102 |

* cited by examiner

*Primary Examiner* — David M Fenstermacher
(74) *Attorney, Agent, or Firm* — Ostrolenk Faber LLP

(57) ABSTRACT

A remote control for controlling machinery that includes a multifunction identifier device incorporating key and starter button functions, the multifunction identifier device including a central body, in which electronic elements are housed, which is assembled with a bearing, the central body including a central part which is closed in the lower portion by an additional part inside which there is housed a magnet, the multifunction identifier device being coupled to an external push button panel by an adjustment ring.

10 Claims, 14 Drawing Sheets

REMOTE CONTROL FOR CONTROLLING MACHINERY

TECHNICAL FIELD OF THE INVENTION

The present invention relates to a remote control for controlling machinery, which can be applied in the industry for the control of industrial equipment, mobile machinery, construction cranes, etc., and more specifically in the field of remote controls for controlling machinery by radio frequency.

BACKGROUND OF THE INVENTION

Remote controls for controlling machinery or cranes by radio frequency generally consist of a remote control transmitter which can be a push button panel, a console and other types of transmitter according to the application, where said transmitter is partly managed by an operator, through which said operator can remotely provide instructions to the machine or crane. The transmitters tend to incorporate a plurality of mechanisms which can consist of push buttons, rotary buttons, selector switches, joysticks or levers, each of which has a different function.

On the other hand, as a safety measure, these remote controls generally include a key which must be introduced by the operator into a slot arranged for such purpose in the remote control and which allows him/her to handle the transmitter, such that without said key the transmitter is deactivated and the remote control cannot be used. Logically, said key aims to assure that only authorized staff can handle the machinery by means of the transmitter. The assured level of safety can also be more or less demanding according to different national regulations.

Likewise, these remote controls tend to incorporate a starter or an activation button which allows activating the machine while awaiting a command. Additionally, after said relay activation, that starter button tends to set off a warning siren, such that the staff surrounding the machine is warned by means of sound signals of the fact that the machine is in a working position, i.e., activated.

Finally, some applications additionally require a selector switch which allows choosing from among a predefined number of positions or options. The number of positions depends on each specific application of the remote control.

From the mechanical and electronic viewpoint, it is a technical challenge to provide all the aforementioned functions in a single remote control given the cost and dimensional difficulty. However, it provides huge advantages in terms of the remote control ergonomics and customization capability.

DESCRIPTION OF THE INVENTION

The present invention relates to a remote control for controlling machinery as defined in claim 1. Other aspects of the invention, as well as a preferred embodiment thereof are defined in the dependent claims.

The possibility of the RFID key using a reader inside the casing of the remote control is contemplated. This reader can be communicated with an RFID identification tag located in the key located in the outer portion of the casing. Since said tag has an electronic identification unit, preferably a 64-bit unique identifier (UID) and a memory, it allows advanced functionalities for access control with different authorization levels, a very high level of security against non-authorized accesses, configuration and equipment customization data storage, etc.

On the other hand, incorporating two three-dimensional Hall effect sensors inside the casing of the remote control is contemplated. One of said sensors is responsible for measuring the interference magnetic field reference, while the other sensor measures the magnetic field of a magnet housed in the multifunction identifier device, where the term identifier corresponds to said device as it incorporates the unique RFID user identification tag, and the term multifunction refers to a button function and to its performance as a selector switch with 1 to 5 positions, as will be described below in more detail. Based on said magnetic field, the angle indicative of the position of the selector switch as well as a possible siren/start pulse can be known.

The remote control comprises a plurality of parts designed for housing both the aforementioned RFID tag and magnet, further providing the key with resistance against industrial environments and the ergonomics necessary for controlling lifting machinery and cranes. Additionally, at the same time, a system which allows customizing the assembly for obtaining a 1, 2, 3, 4 or 5 step selector switch, as required by the user, has been developed. For this purpose, the central body comprises a turn and push lever which has 4 holes through which a nail acting as a stop can be introduced, which allows customizing the assembly as a 1, 2, 3 and 4 step selector switch. Without adding the nail, the system conventionally provides 5 steps. A simple way of providing a selector switch with a different number of steps depending on each application is thus achieved.

The greatest difficulties in the development of a solution lie in obtaining elements which allow achieving user's feeling for the mechanism, as well as the robustness and durability thereof. Furthermore, difficulties have also been encountered in ensuring that the magnet necessary for the starter button/siren and selector switch function does not excessively reduce the range of the system, while at the same time generates sufficient magnetic field for the correct operation of the selector switch and of the RFID starter button/siren.

The remote control proposed by the invention allows, with reduced dimensions, optimizing the cost and size of remote control transmitters by implementing at least the start and key functions, and optionally the selector switch function. Furthermore, according to a preferred embodiment the shell of the remote control does not need holes which compromise the tightness of the remote control, which is very useful in industrial environments in which the remote control operates.

Therefore, the remote control of the invention implements the key function, the starter button function, optionally the siren function, and also optionally, the selector switch function in a single, low-cost, very small-sized element. In the case of the selector switch option, the starter button or siren function can change according to the position of the selector switch, being used for example to switch on a spotlight, a camera, etc. To that end, in addition to the radio frequency identification system, abbreviated as RFID, and the Hall effect system, mechanical elements which, as detailed below in a preferred embodiment of the invention, allow housing all the components relating to said RFID and Hall effect systems, providing suitable resistance and ergonomics for said applications, have been designed.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting character.

PREFERRED EMBODIMENT OF THE INVENTION

Figure 1:
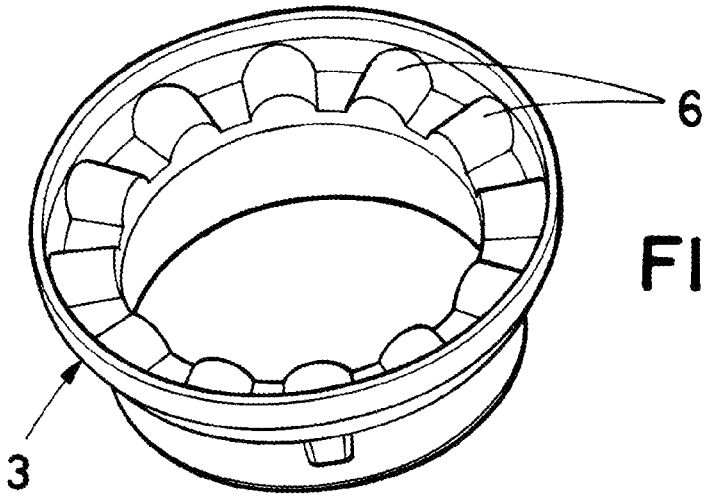
FIGS. 1 to 7 show different perspective views in the assembled and exploded position of the assembly of the bearing comprised by the remote control of the invention.
Figure 2:
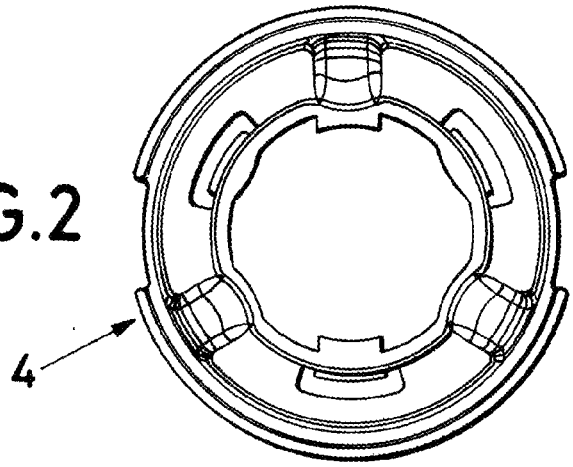
Figure 3:
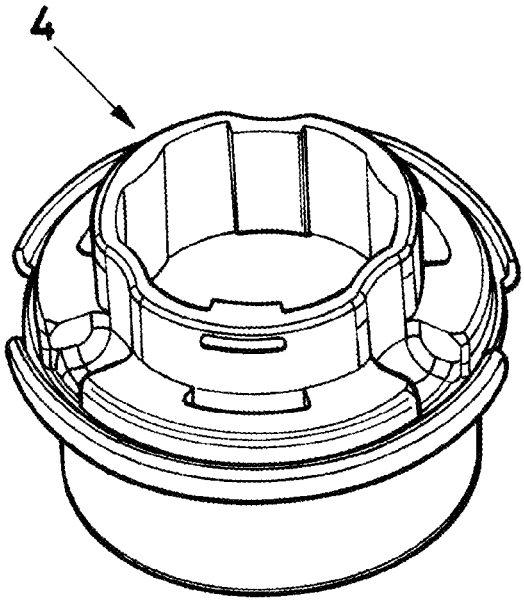
Figure 4:
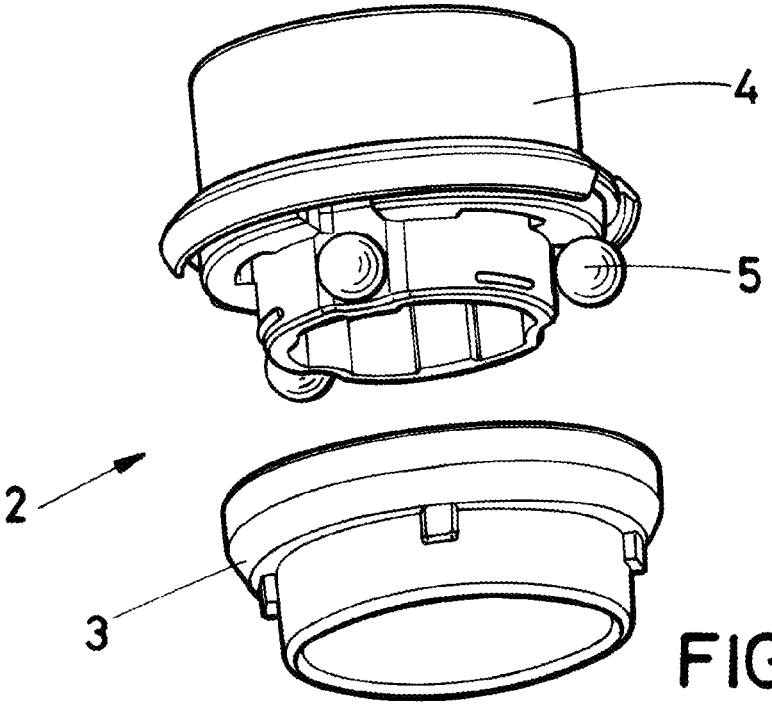
Figure 5:
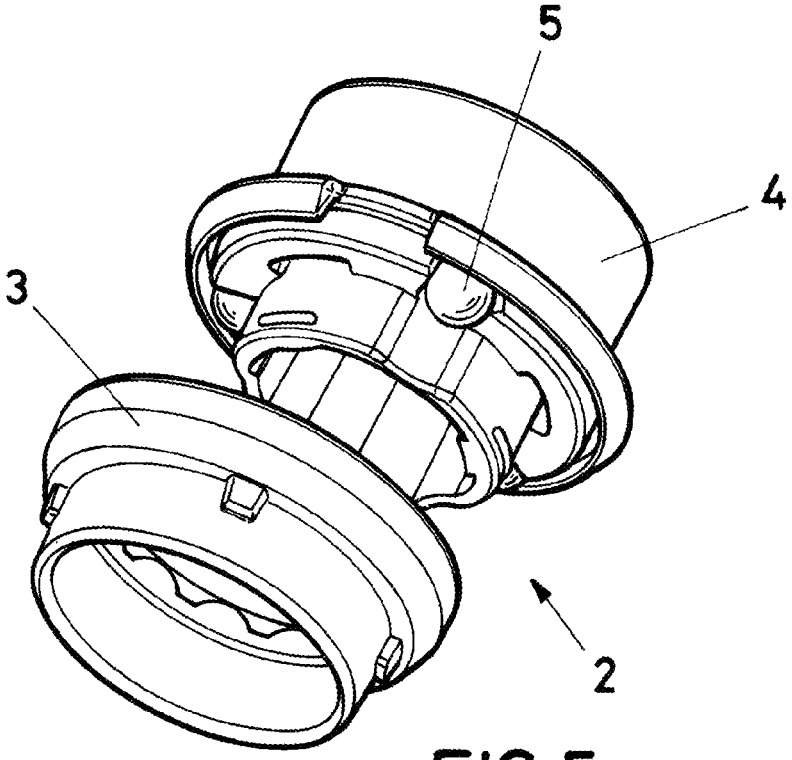
Figure 6:
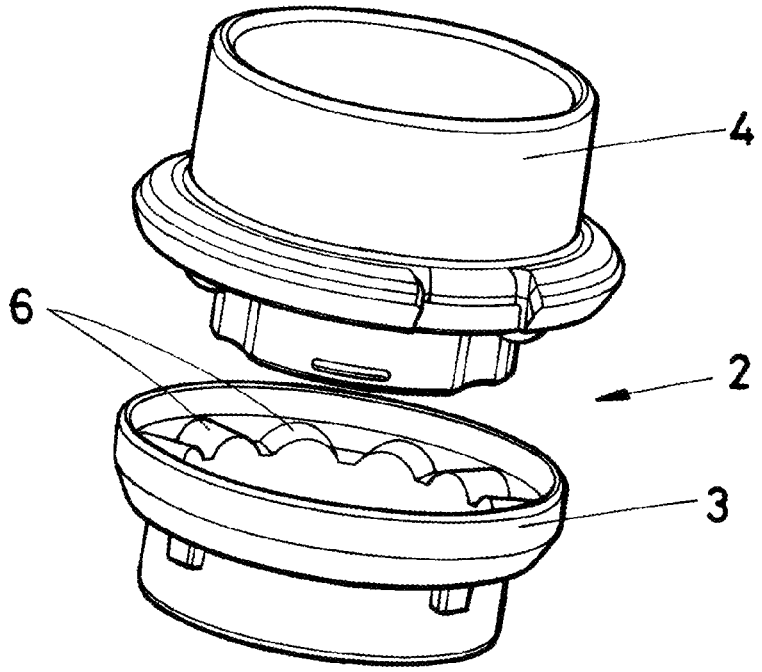
Figure 7:
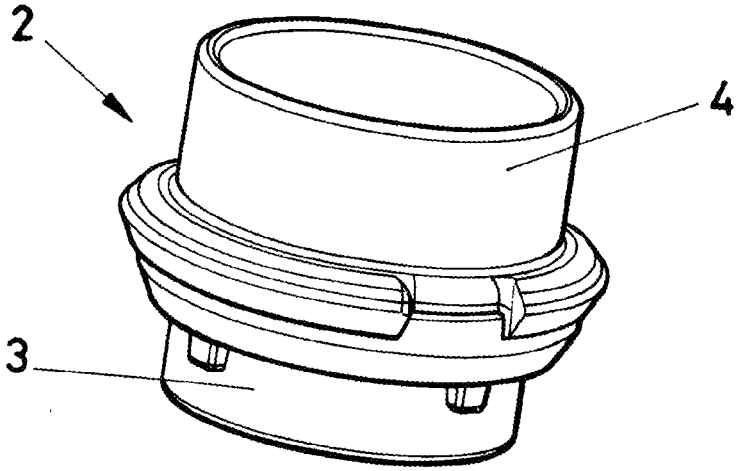
Figure 8:
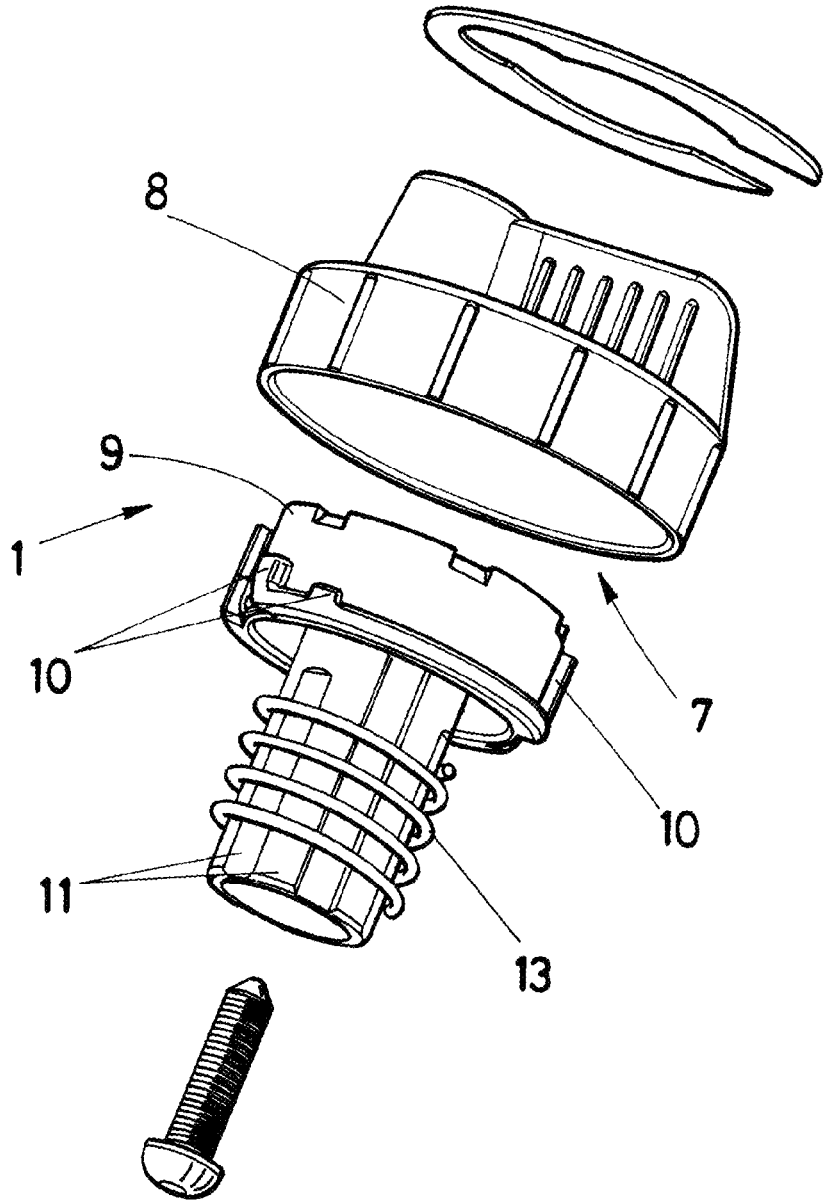
FIGS. 8 to 13 show different perspective views in the assembled and exploded position of the assembly of the central body comprised by the remote control of the invention.
Figure 9:
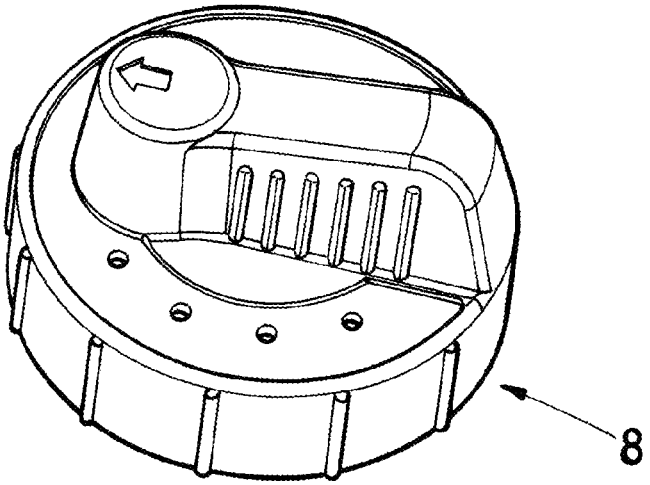
Figure 10:
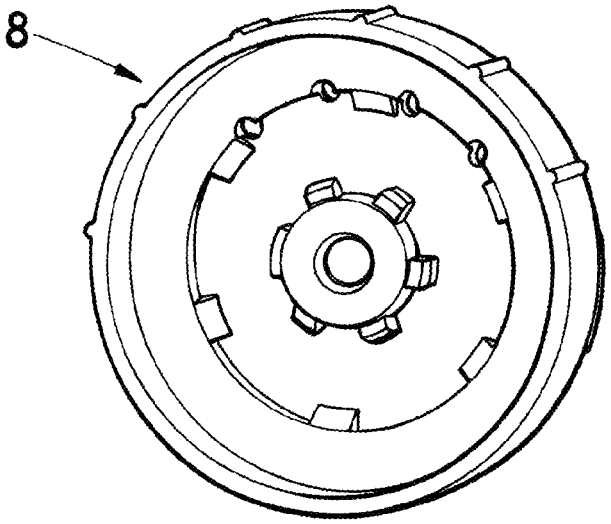
Figure 11:
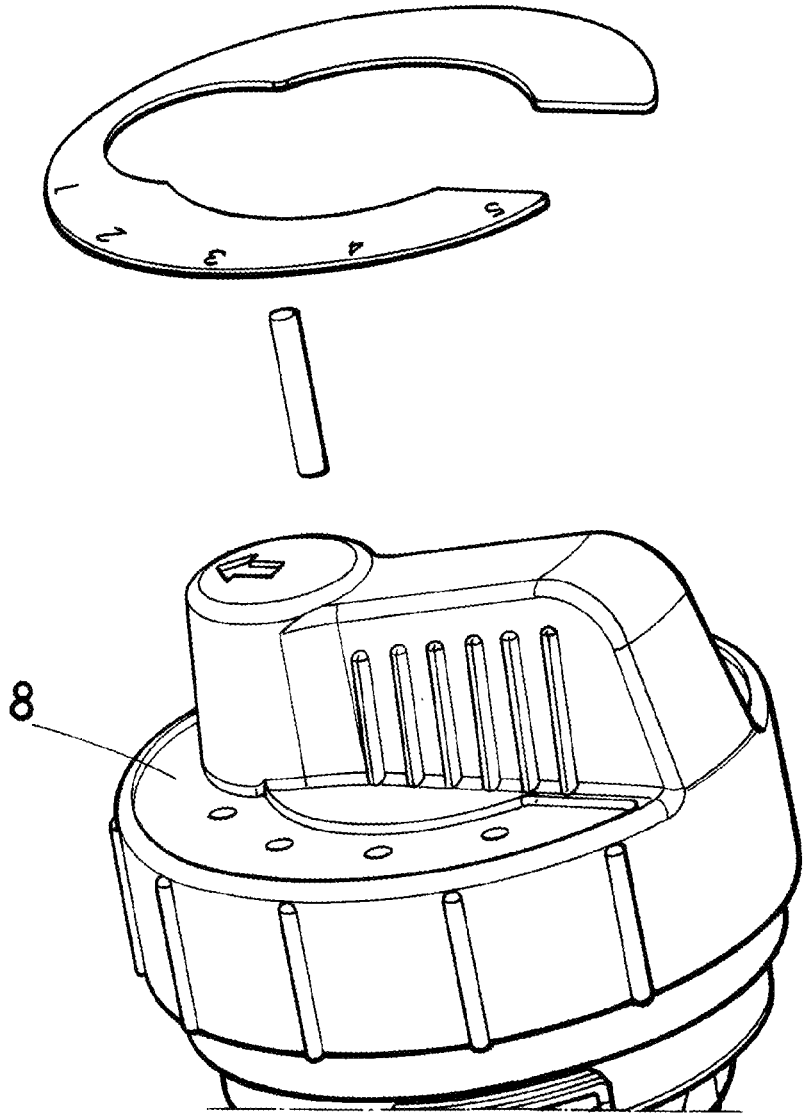
Figure 12:
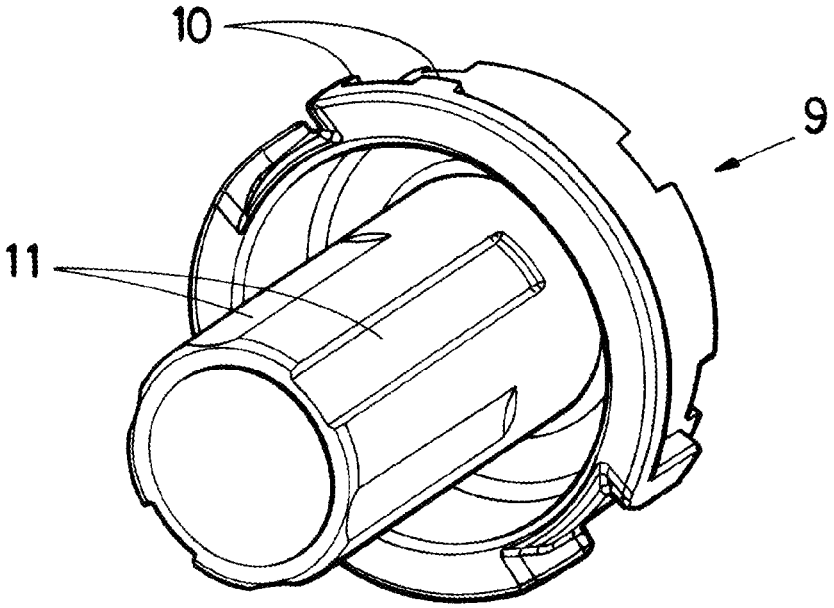
Figure 13:
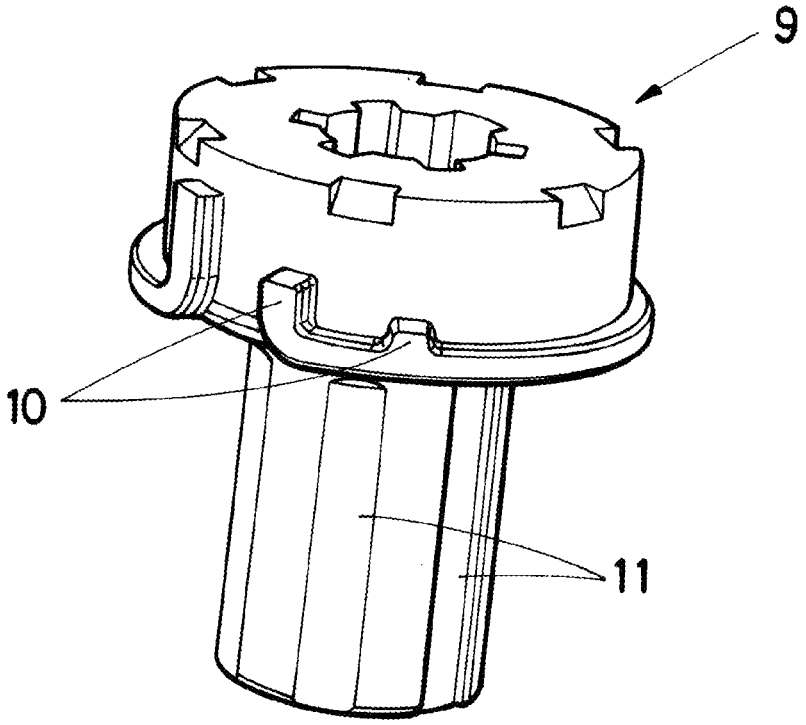

In view of the mentioned drawings, it can be observed how the remote control comprises in one of the possible embodiments of the invention a multifunction identifier device (1) which is made up of a series of parts that are coupled to one another as detailed below.

The assembly of a bearing (2) comprised by the remote control can be seen in FIGS. 1 to 7. Said bearing (2) comprises an assembly of two bearing parts (3, 4), consisting of a lower bearing part (3) and an upper bearing part (4), forming a bearing together with three balls (5). According to a preferred embodiment, these three balls (5) have a diameter of 2.5 mm and slide through the lower bearing part (3) which internally has 12 outer projections (6) or menisci arranged every 30°. The three balls (5) are housed inside the upper bearing part (4) and arranged 120° with respect to one another. In addition to providing the turning system with the stability necessary to eliminate pitching in the turning movement, this arrangement gives feeling to the invention, necessary so that a step can be established and felt every 30°.

The assembly of a central body (7) comprised by the remote control can be seen in FIGS. 8 to 13. Said central body (7) comprises an assembly of two parts attached to one another with a screw forming the central body (7). The central body (7) comprises a turn and push lever (8) which has 4 holes through which a nail or metal pin acting as a stop can be introduced which allows customizing the assembly as a 1, 2, 3 and 4 step selector switch. Without adding the nail, the system conventionally provides 5 steps. Said selection function can be seen in FIGS. 9 to 11, specifically the use of a metal pin to block the path of the lever (8) or rotary selector switch to the $1^{st}$, $2^{nd}$, $3^{rd}$ or $4^{th}$ position can be seen in FIG. 11. Exclusion of the metal pin is sufficient to achieve the performance of 5 positions. A simple way of arranging a selector switch with a different number of steps depending on each application is thus achieved.

The tag, in addition to the corresponding signaling, fixes and conceals the nail while at the same time prevents the accidental removal thereof.

The central body (7) comprises a central part (9) with a cylindrical configuration with a wider upper portion, where said central part (9) has a plurality of guides and stops (10, 11) which provides the system with the desired operation. Said guides and stops are broken down into upper guides and stops (10), located in the upper portion of the central part (9), and are intended for limiting and guiding the movement of the entire assembly formed by the central body (7) and bearing (2) along the suitable route. On the other hand, the guides and stops are broken down into central guides and stops (11), located in the central portion of the central part (9), serving to guide and position the bearing (2) with respect to the assembly of the multifunction identifier device (1).

Figure 14:
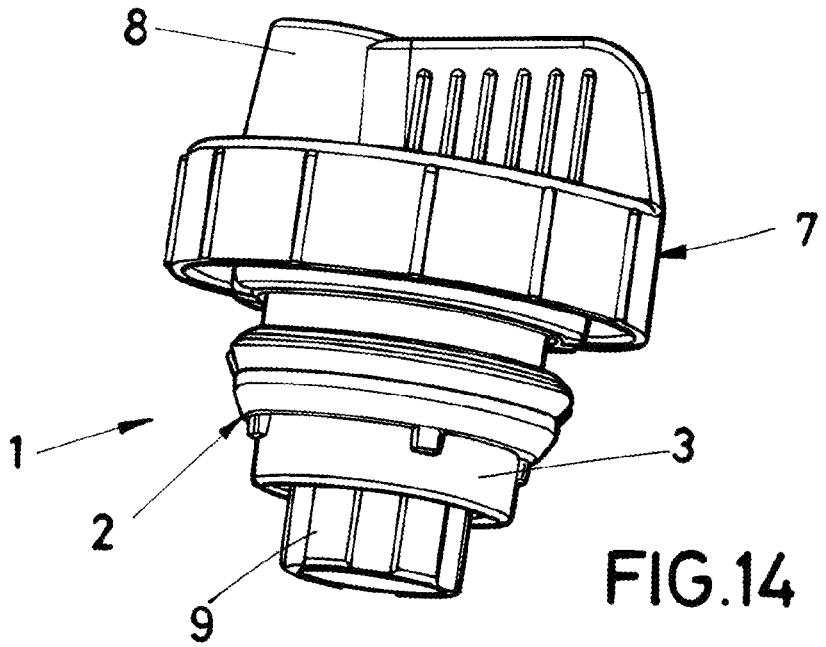
FIGS. 14 to 16 show three perspective views in the assembled and exploded position of the assembly of the central body with the electronic elements and the bearing of the remote control, as well as the arrangement of the return spring.
Figure 15:
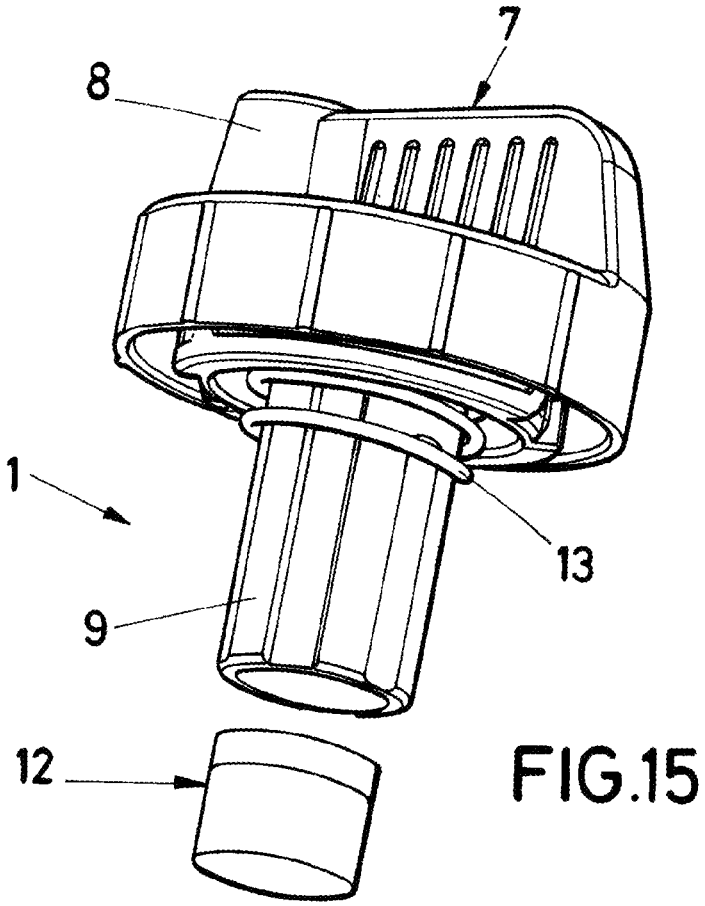
Figure 16:
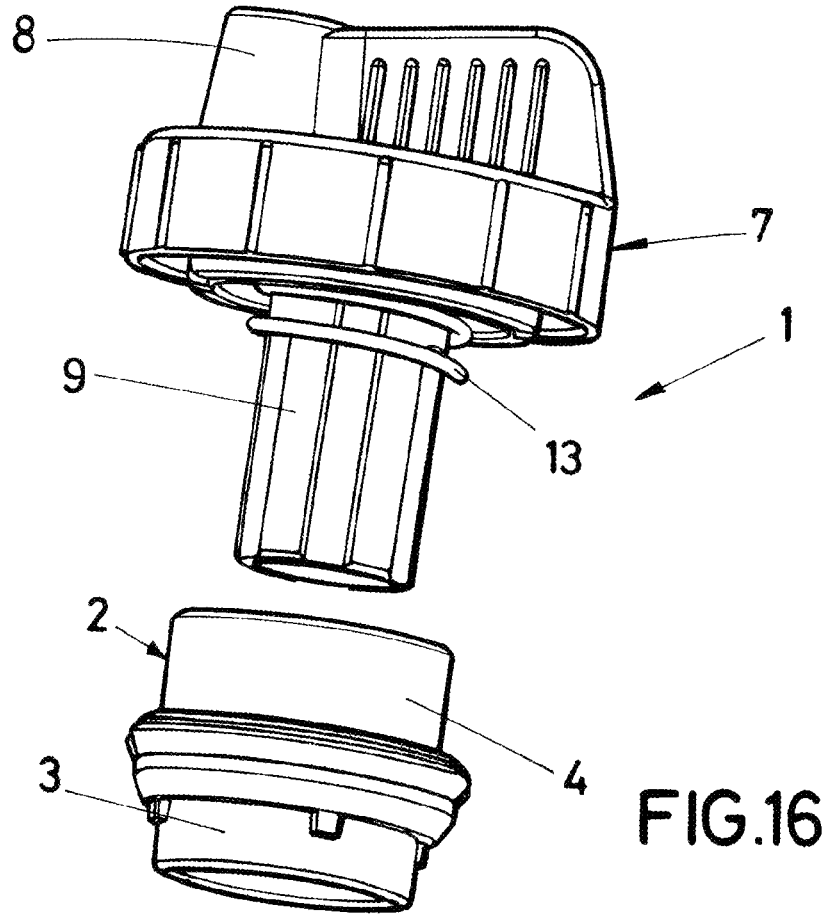

FIGS. 14 to 16 show the assembly sequence for assembling the central body (7), the electronic elements (12), the bearing (2) and a return spring (13) arranged for acting elastically between the central body (7) and the bearing (2). The electronic elements (12), also referred to simply as electronics, are introduced in the inner portion of the central part (9), the return spring (13) is subsequently placed followed by the bearing (2), such that the spring (13) presses the bearing (2) downwards. The electronic elements (12) can consist of a radio frequency identification tag, referred to as RFID tag, which is the electronics introduced into the central part (9) of the multifunction identifier device (1), and other components necessary for the correct operation thereof.

The multifunction identifier device (1) incorporates a magnet, which allows activating the HALL effect sensor. The magnet is incorporated within an additional part (14), as can be seen in FIG. 17

Figure 17:
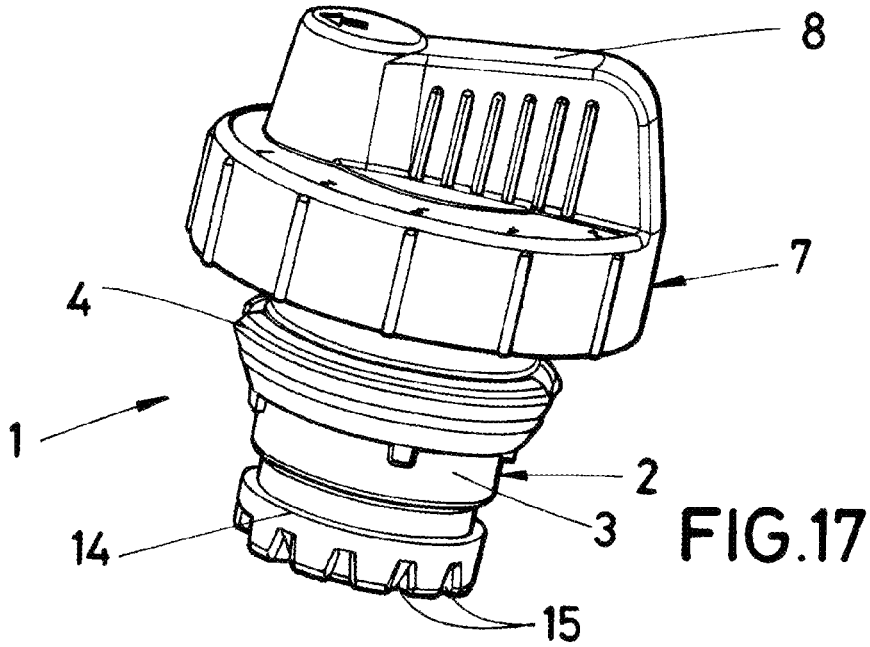
FIG. 17 shows a perspective view of the closure and sealing elements of the assembly of the remote control.
Figure 18:
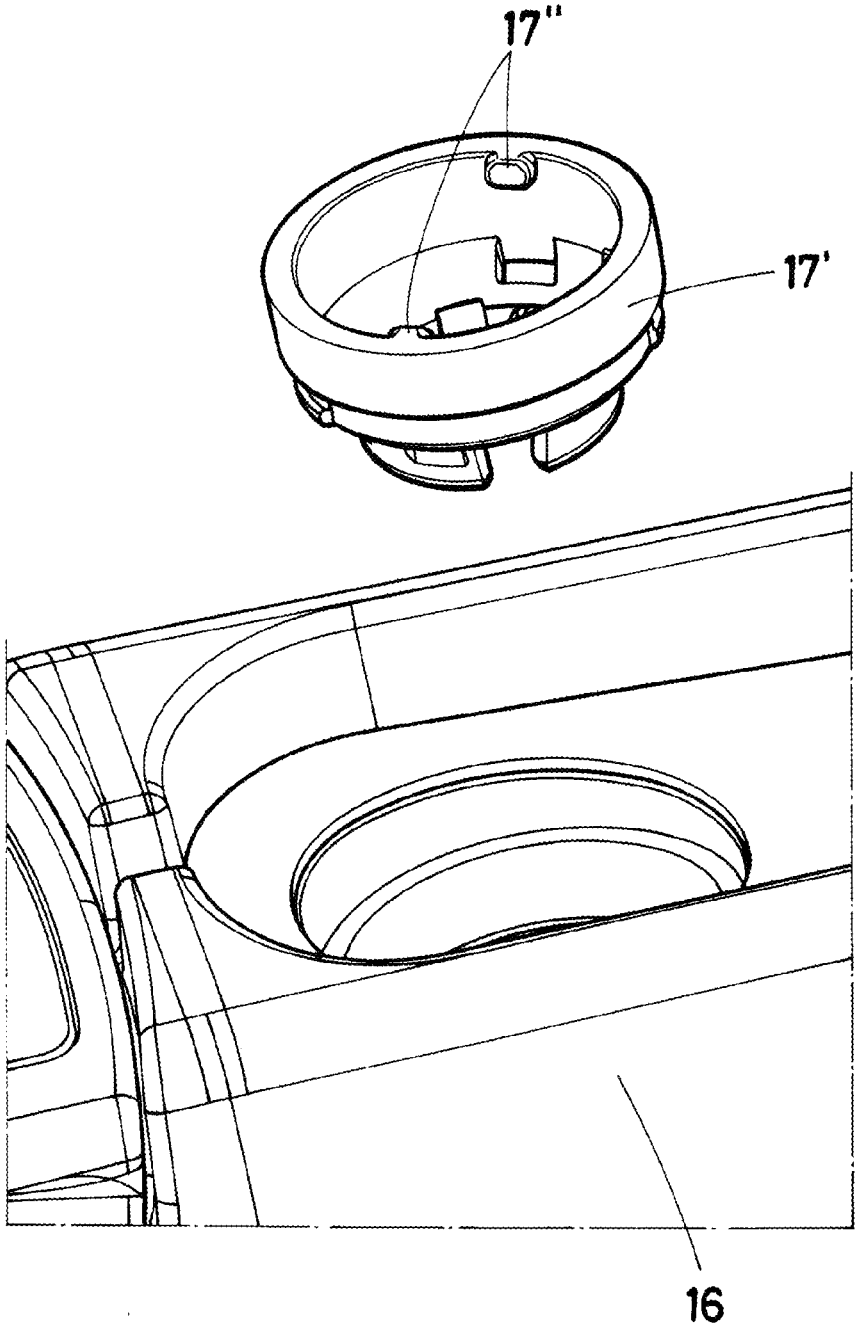
FIGS. 18 to 23 show different perspective views in the assembled and exploded position of the assembly between the adjustment ring of the multifunction identifier device to different push button panels.
Figure 19:
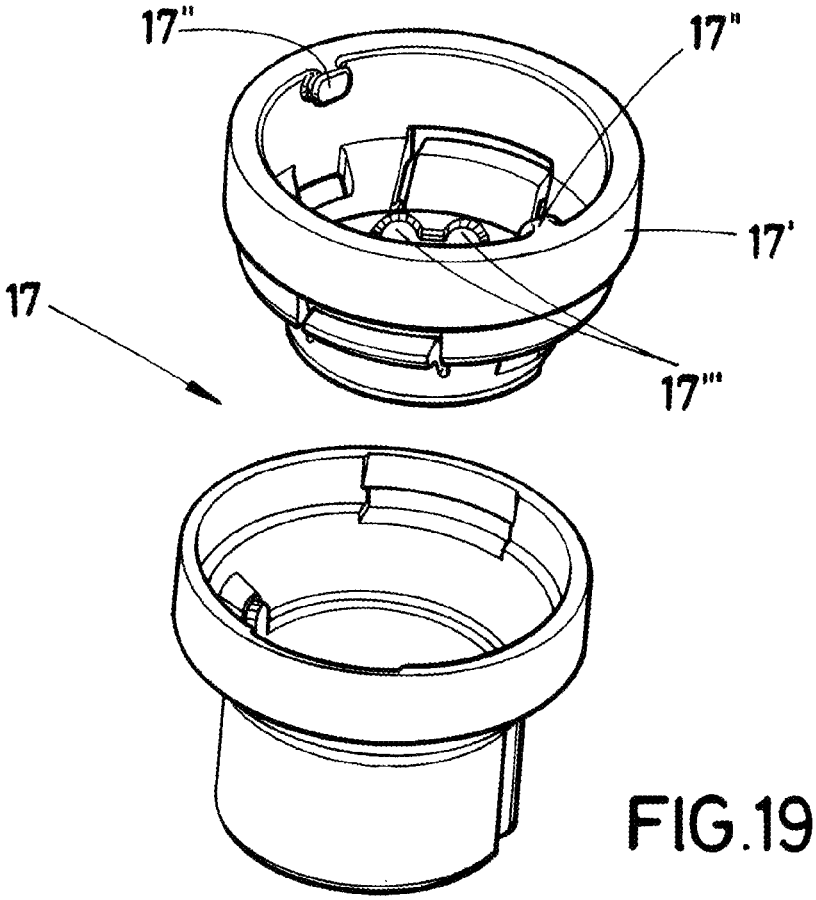
Figure 20:
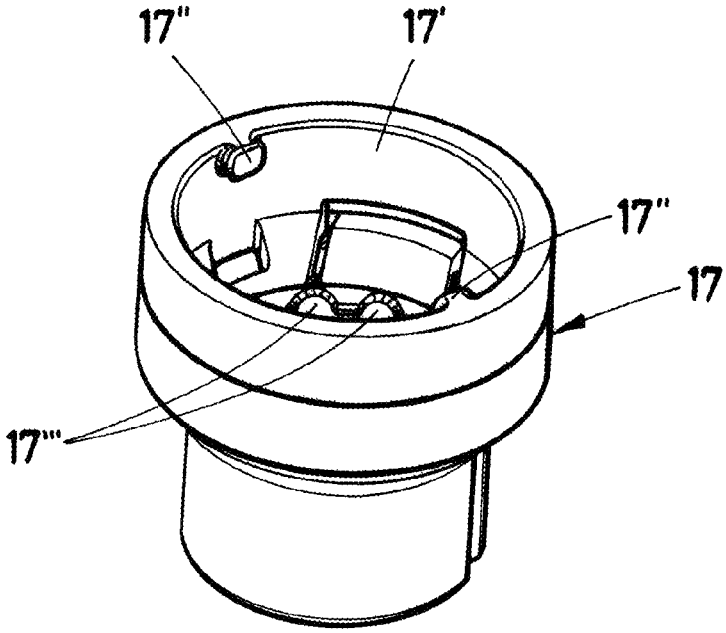
Figure 21:
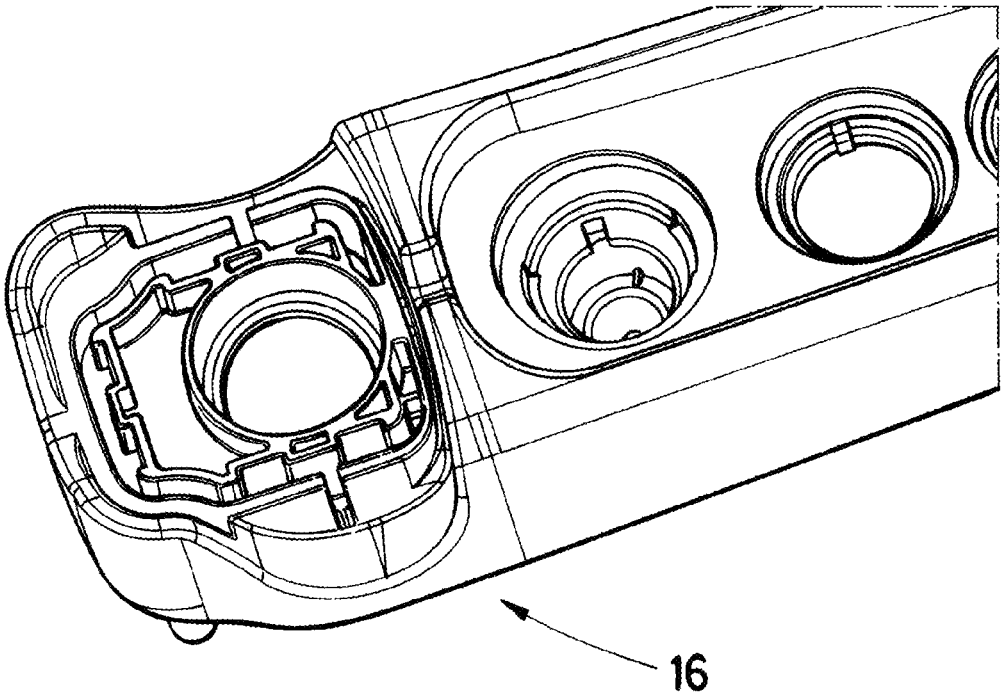
Figure 22:
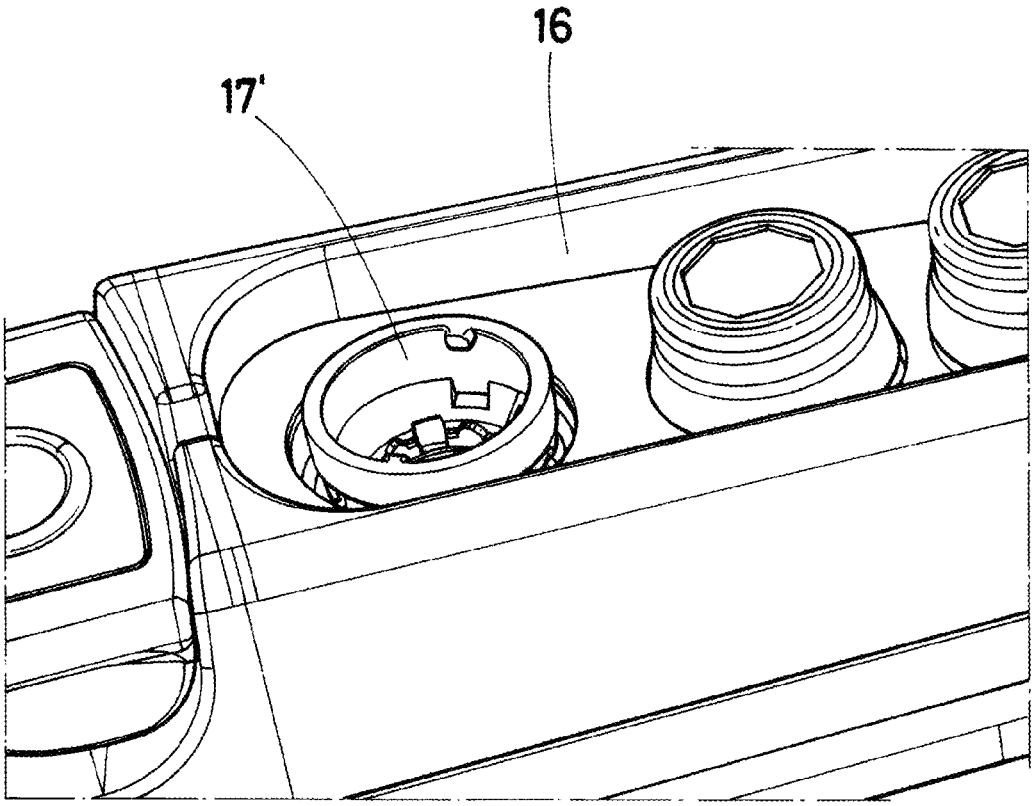
Figure 23:
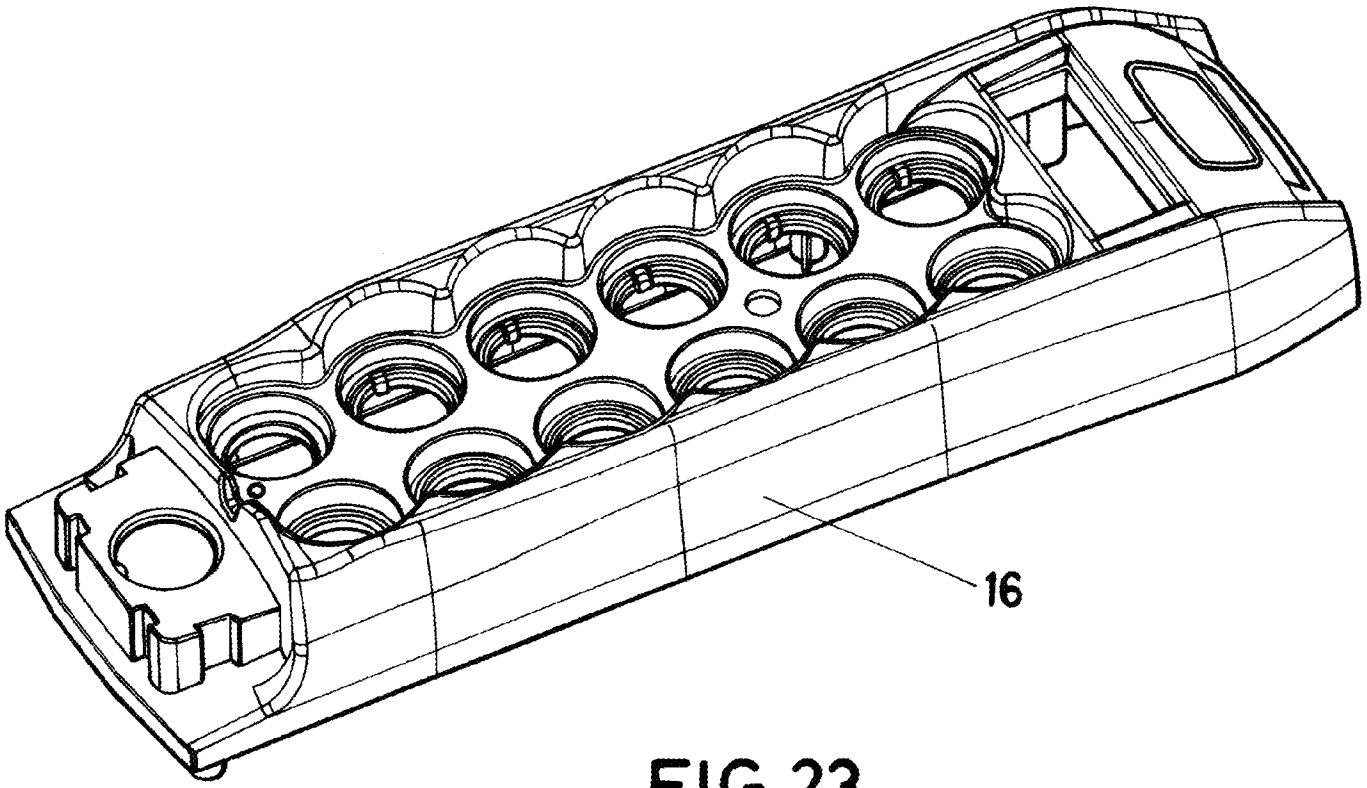

Likewise, said FIG. 17 shows the closure and sealing of the assembly. The magnet is placed inside the additional part (14) and it additionally acts as a stopper for sealing the assembly of the multifunction identifier device (1). The magnet is a North-South magnet. The magnet will be placed in any North/South orientation. Before closing the assembly with the additional part (14), it is filled with an adhesive sealing resin. The additional part (14) in turn has in its lower portion a plurality of notches (15) or cavities which block the assembly at the time of pushing and prevent turning it.

For the assembly of the multifunction identifier device (1) in a push button panel (16), the remote control of the invention comprises an adjustment ring (17). FIGS. 18 to 23 show the assembly of the adjustment ring (17) and of the multifunction identifier device (1) to commercial TM70, TM80 push button panels (16). The adjustment ring (17) acts as an adaptor of the push button panels (16) and it is on it that the entire mechanism runs. The adjustment ring comprises an upper portion (17') having two ribs (17") through which the key is introduced. These ribs (17") preferably have different geometries to prevent introducing the key erroneously. The upper portion (17') of the adjustment ring (17) has inside same 12 projections (17''') or mesnisci arranged every 30° matching the outer projections (6) of the lower bearing part (3).

In view of this description and set of drawings, the person skilled in the art will understand that the embodiments of the invention which have been described can be combined in many ways within the object of the invention. The invention has been described according to several preferred embodiments thereof, but for the person skilled in the art it will be evident that multiple variations can be introduced in said preferred embodiments without exceeding the object of the claimed invention.

The invention claimed is:

1. A remote control for controlling machinery, comprising a multifunction identifier device incorporating key and starter button functions, for which purpose said multifunction identifier device comprises a central body, in which electronic elements are housed, which is assembled with a bearing, wherein said central body comprises a central part which is closed in the lower portion by an additional part inside which there is housed a magnet, wherein said bearing of said multifunction identifier device is coupled to an adjustment ring which is received by an outer push button panel.

2. A remote control according to claim 1, wherein the bearing comprises an assembly of two bearing parts, the assembly including a lower bearing part and an upper bearing part, and balls sliding through the lower bearing part which internally has a plurality of outer projections, said balls being housed inside the upper bearing part.

3. A remote control according to claim 1, wherein the central body comprises a turn and push lever which is attached in the upper portion to the central part with a cylindrical configuration having a plurality of guides and stops which are broken down into upper guides and stops, located in the upper portion of the central part, which limit and guide the movement of the assembly formed by the central body and bearing, and central guides and stops, located in the central portion of the central part, which guide and position the bearing with respect to the assembly of the multifunction identifier device.

4. A remote control according to claim 3, wherein the central body comprises a turn and push lever which has 4 holes through which a nail can be introduced which allows customizing the assembly as a 1, 2, 3 and 4 step selector switch.

5. A remote control according to claim 3, wherein the central body comprises a return spring arranged for acting elastically between the central body and the bearing.

6. A remote control according to claim 3, wherein there are electronic elements in the inner portion of the central part, the electronic elements including a radio frequency identification tag, the multifunction identifier device incorporating a magnet located within an additional part which acts as a stopper for sealing the assembly of the multifunction identifier device.

7. A remote control according to claim 6, wherein the additional part has in its lower portion a plurality of notches which block the assembly at the time of pushing and prevent turning it.

8. A remote control according to claim 1, wherein the adjustment ring comprises an upper portion having two ribs through which the key is introduced.

9. A remote control according to claim 1, wherein the adjustment ring, at the upper portion inside same, has 12 projections matching the outer projections of the lower bearing part.

10. A remote control for controlling machinery, comprising a multifunction identifier device incorporating key and starter button functions, for which purpose said multifunction identifier device comprises, a central body having a central part;

electronic elements housed in the central part;

a bearing assembled on the central part;

an additional part that closes an open end of said central part;

a magnet housed in said additional part; and an adjustment ring received by an outer push button panel;

wherein said multifunction identifier device is coupled to said adjustment ring.

* * * * *